US008214132B2

(12) United States Patent
Bunni et al.

(10) Patent No.: US 8,214,132 B2
(45) Date of Patent: Jul. 3, 2012

(54) EFFICIENT WAVE FORM TO CONTROL FUEL SYSTEM

(75) Inventors: Nadeem Bunni, Cranberry Township, PA (US); Daniel R. Puckett, Peoria, IL (US); Jay Venkataraghavan, Dunlap, IL (US); Stephen R. Lewis, Chillicothe, IL (US); Angela L. Moore, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 106 days.

(21) Appl. No.: 12/884,798

(22) Filed: Sep. 17, 2010

(65) Prior Publication Data

US 2012/0067329 A1 Mar. 22, 2012

(51) Int. Cl.
*F02D 41/26* (2006.01)

(52) U.S. Cl. ..... 701/106; 123/472; 123/480; 123/490

(58) Field of Classification Search ..... 123/472, 123/478, 479, 480, 486, 490; 701/103–106
See application file for complete search history.

(56) References Cited

U.S. PATENT DOCUMENTS 4,729,056 A * 3/1988 Edwards et al. ..... 361/153
4,922,878 A 5/1990 Shinogle et al.
5,430,601 A * 7/1995 Burcham ..... 361/154
6,031,707 A * 2/2000 Meyer ..... 361/153
6,102,004 A 8/2000 Cowden et al.
6,167,869 B1 1/2001 Martin et al.
6,760,212 B2 7/2004 Cheever, Jr. et al.
6,880,530 B2 * 4/2005 Oyama et al. ..... 123/479
7,143,641 B2 12/2006 Palazzolo et al.
7,154,729 B2 12/2006 Tanzawa et al.
7,784,445 B2 * 8/2010 Takahashi et al. ..... 123/479
8,018,216 B2 * 9/2011 Kakehi ..... 323/288
8,081,498 B2 * 12/2011 Mayuzumi et al. ..... 363/59
2002/0005187 A1 * 1/2002 Herzog et al. ..... 123/490

* cited by examiner

*Primary Examiner* — Hai Huynh

(57) ABSTRACT

An efficient control wave form is utilized to actuate the solenoids of a fuel system to reduce boost power/energy consumption. The solenoid is initially energized by applying a boost voltage from an electronic controller across a solenoid coil circuit. The electronic controller monitors the current level in the solenoid coil circuit, and changes to a reduced battery voltage when the current level in the solenoid coil circuit reaches a predetermined trigger current. The controller then maintains a pull-in current based upon battery voltage for a pull-in duration that initiates movement of the solenoid armature from an initial air gap position toward a final air gap position. After the pull-in duration, the current level is dropped to a hold in level for the remaining duration of the actuation event. The solenoid may be used for fuel injector control and/or pump control, such as to control fuel injection and pumping events respectively.

20 Claims, 4 Drawing Sheets

EFFICIENT WAVE FORM TO CONTROL FUEL SYSTEM

TECHNICAL FIELD

The present disclosure relates generally to electronically controlled fuel systems, and more particularly to an efficient wave form for controlling the operation of solenoids in fuel injectors and/or pumps of a fuel system.

BACKGROUND

Today's electronically controlled fuel systems typically include numerous electrical actuators whose activation is controlled by an electronic controller. For instance, fuel injectors may include one or more electrical actuators to control injection timing and/or injection quantity. In common rail fuel systems, an electronically controlled pump or other actuator may control pressure in a common rail that supplies pressurized fuel to a bank of fuel injectors. While both piezo and solenoids are known for use as electrical actuators in fuel systems, solenoids continue to dominate in most applications. Over the years, there has been a continuous effort to improve actuator performance through various solenoid design strategies, pressure control strategies, mass property improvements, control wave forms and other considerations in an effort to improve consistency, robustness and speed, as well as other performance characteristics.

Co-owned U.S. Pat. No. 4,922,878 teaches a typical wave form control strategy for energizing a solenoid of a fuel injector to perform an injection event. The '878 patent teaches an electronic controller that has the ability to briefly apply a substantially higher voltage to the solenoid circuit to initiate movement of an armature of the solenoid to commence an injection event. For instance, this higher voltage may be supplied by capacitors that are continuously charged from system voltage "battery" between injection events. In order to hasten the time delay between initially applying a voltage to the solenoid circuit and the time at which the armature actually starts moving, the conventional wisdom has been to maintain the elevated voltage across solenoid circuit until the solenoid armature begins moving from its initial air gap position toward its final air gap position. During this initial period, current in the solenoid circuit is controlled to have a saw tooth pattern by the electronic controller maintaining current between a minimum and a maximum current by opening the circuit when the maximum circuit is reached, then closing the circuit at the minimum current, and repeating this process during what is commonly referred to as the pull-in duration. At the end of the pull-in duration, the controller may then drop to a battery voltage and a lower tier average current since less energy is needed to continue movement of the armature, and maybe even less energy needed to hold the armature at its final air gap position. These lower tiered current levels after the pull-in duration are often referred to as hold-in current levels.

As is well known in the art, movement of the solenoid armature changes a pressure configuration within the fuel injector causing a fuel injection event to occur. When it comes time to end the injection event, the circuit is opened, current decays and a bias (e.g. spring) moves the armature back toward its initial air gap position to again change a pressure condition within the fuel injector and end the injection event. While this type of wave form control strategy has worked well for many years, there are continued efforts being made to decrease hardware requirements and reduce power/energy requirements without compromising performance.

The present disclosure is directed toward one or more of the problems set forth above.

SUMMARY OF THE DISCLOSURE

In one aspect, a method of operating a fuel system for an engine includes energizing a solenoid of the fuel system and then later deenergizing the solenoid. The energizing step includes applying a boost voltage from an electronic controller across a solenoid coil circuit, and changing from the boost voltage to a reduced voltage responsive to a current in the solenoid coil circuit reaching a trigger current.

In another aspect, an electronic controller for a fuel system of an engine includes a processor, a memory in communication with the processor, a solenoid coil circuit port, a battery port and a driver circuit that includes a boost power source. A solenoid actuation algorithm that is stored on the memory and executable by the processor is configured to electrically connect the solenoid coil circuit port to the driver circuit to provide a boost voltage, then electrically disconnect the solenoid coil circuit port from the driver circuit responsive to a current through the solenoid coil circuit port reaching a trigger current, and then electrically connecting the solenoid coil circuit port to the battery port.

In still another aspect, a method of operating a solenoid of a fuel injector for an engine includes applying a boost voltage from an electronic controller across a solenoid coil circuit. The solenoid coil current is compared to a predetermined trigger current. Voltage in the solenoid coil circuit is changed from the boost voltage to a reduced voltage responsive to a current in the solenoid coil circuit reaching the trigger current.

DETAILED DESCRIPTION

Figure 1:
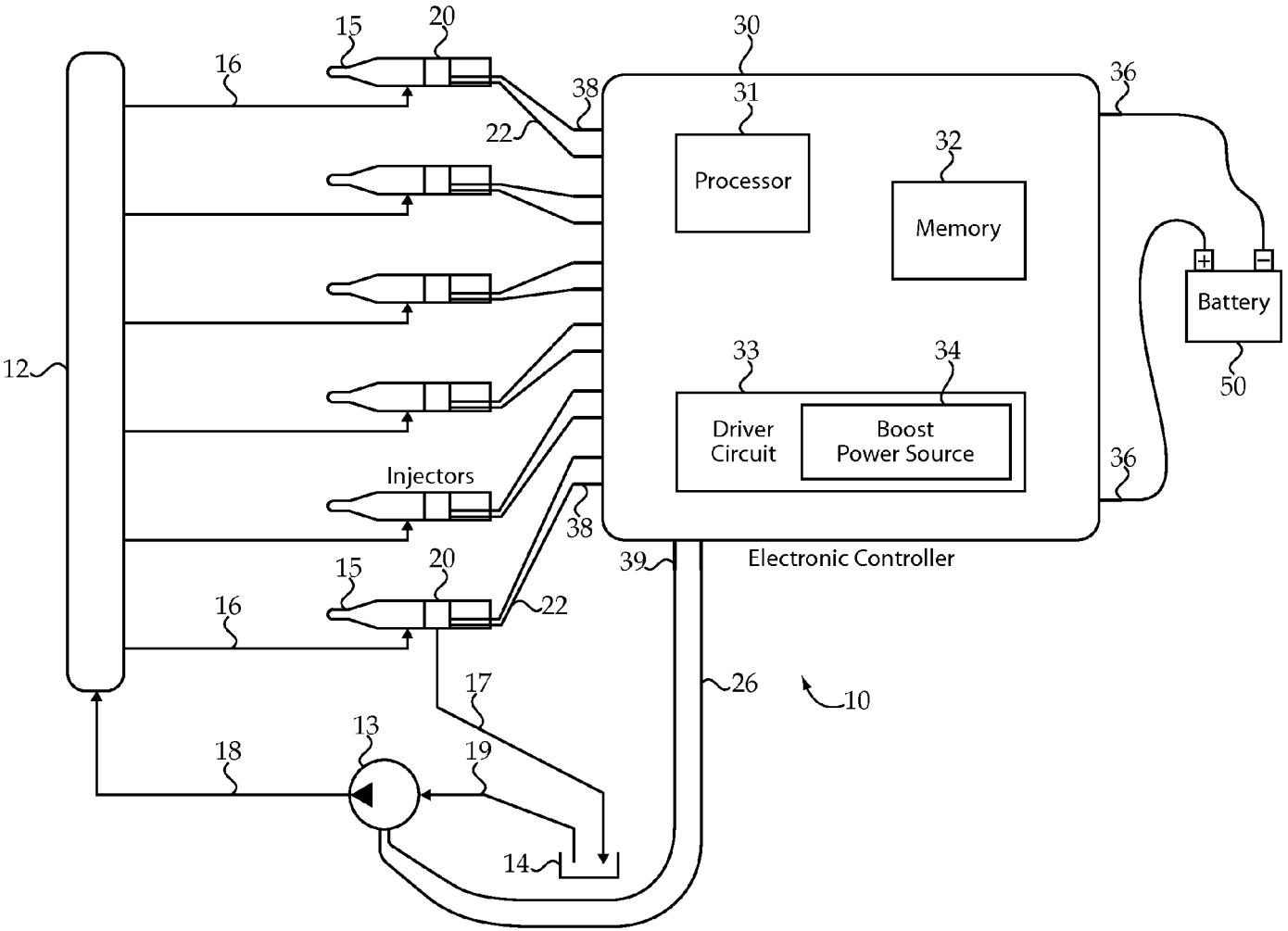
FIG. 1 is a schematic view of a fuel system for an engine according to the present disclosure.

Referring to FIG. 1, a fuel system 10 for a compression ignition engine includes a common rail 12 that supplies pressurized fuel to individual fuel injectors 15 via individual branch passages 16. A high pressure pump 13 is supplied with fuel from tank 14 via a low pressure supply line 19. An outlet from high pressure pump 13 is fluidly connected to common rail 12 via a high pressure supply line 18. Although only one is shown, each fuel injector 15 is fluidly connected to tank 14 by a low pressure return line. Each fuel injector 15 includes a solenoid 20 that may be energized via a voltage applied by electronic controller 30 to individual solenoid coil circuit 22. The solenoid coil circuits 22 are electrically connected to respective solenoid circuit ports 38 of electronic controller 30. The output from pump 13, and hence the pressure in common rail 12 is also controlled by electronic controller 30 via a pump circuit 26 that is electrically connected to controller 30 at pump circuit port 39. High pressure pump 13 may or may not be of a type that has a control feature that may benefit from the efficient wave form of the present disclosure. For instance, pump 13 may be an inlet throttle metered pump those inlet flow area is controlled by an electronic controller that may not benefit from the efficient wave form of the present disclosure. On the otherhand, high pressure pump 13 may be an outlet metered pump those outlet is controlled by one or more solenoid actuated spill valves known in the art that could benefit from the efficient wave form of the present disclosure. Thus, electronic controller 30 controls injection pressure via output for pump 13, and controls injection timing via the energization and deenergization of individual solenoids 20 to control the opening and closing of nozzle outlets for an injection event.

Electronic controller 30 is of a well known structure, in that it includes a processor 31 that is configured to execute programmable code stored on memory 32. Electronic controller 30 also includes a driver circuit 33 that includes a boost power source 34, and electronic controller 30 is also electrically connected to a battery 50 via battery port 36. When executing code stored on memory 32, processor 31 can electrically connect solenoid circuit ports 38 and/or pump circuit port 39 to either driver circuit 33 for an elevated boost voltage, or electrically connect the same to battery 50 for a reduced voltage on the respective solenoid coil circuits 22 and/or pump circuit 26. Boost power source 34 may include one or more capacitors that may be continuously charged with electrical energy from battery 50, but are capable of being discharged through driver circuit 33 to provide an elevated boost voltage that may be many times greater than the voltage associated with battery 50. For instance, battery voltage may be on the order of 12 volts, whereas the boost voltage may be on the order of 100 volts. Although the boost voltage will always be greater than the battery voltage, those skilled in the art will appreciate that the magnitude of the boost voltage is a matter of design choice taking into account known considerations including cost and performance, among other considerations. Although the present disclosure is illustrated in the context of a common rail fuel system for a compression ignition engine, those skilled in the art will appreciate that the concepts of the present disclosure may also apply to any electronically controlled fuel system (e.g. cam actuated fuel injectors) for any type of engine (e.g., spark ignited, gaseous fuel, heavy fuel, etc.)

Those skilled in the art will appreciate that solenoids utilized in both fuel injectors and pumps for electronically controlled fuel systems include well known features in common to all. For instance, a solenoid includes a stationary stator that assists in channeling magnetic flux generated by a solenoid coil to move an armature from an initial air gap position to a final air gap position. For instance, fuel injectors 15 might be equipped with a direct operated check in which the armature movement serves to allow a coupled valve member to move to connect and disconnect a pressure control chamber to drain to allow a needle valve member to open and close to perform an injection event in a well known manner. On the otherhand, in the case of pump, the movement of the solenoid armature may close a spill valve associated with the pumping chamber to displace a controlled fraction of a pump displacement to the high pressure common rail while spilling another fraction of the displacement back to tank at a low pressure.

Figure 2:
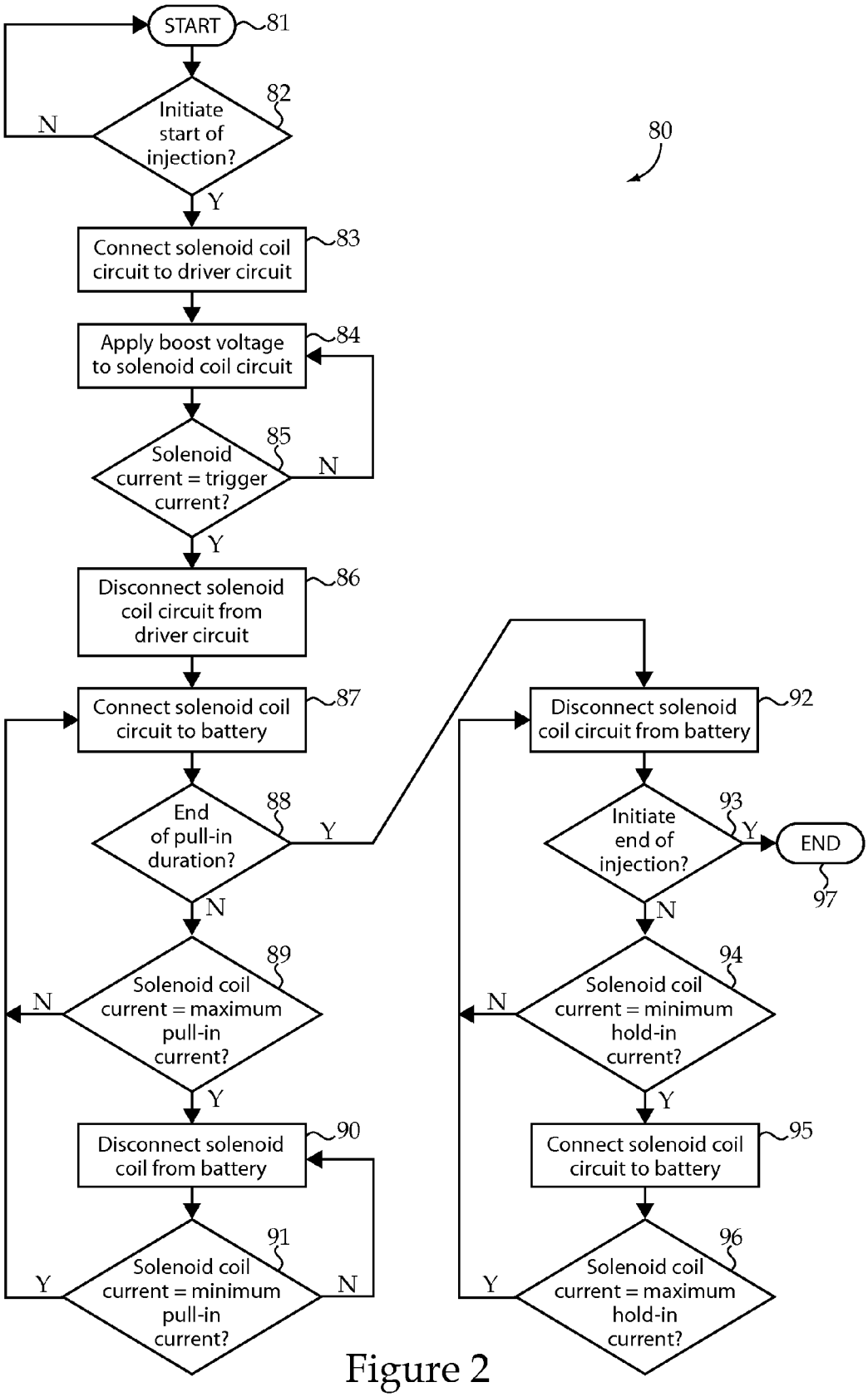
FIG. 2 is a logic flow diagram of a solenoid actuation algorithm according to another aspect of the present disclosure.

FIG. 2 shows an example solenoid actuation algorithm 80 that could be encoded and stored on memory 32 for execution by processor 31 to control the action of solenoids 20 of the individual fuel injectors 15. Nevertheless, a similar solenoid actuation algorithm could also be suitable for controlling pump events in certain electronically controlled pumps known in the art that utilize one or more solenoids to control their operation. Those skilled in the art will appreciate that the general goal of any solenoid in its control features are to move the armature quickly and efficiently from its initial air gap position to its final air gap position to meet the performance requirements of the fuel system while doing so with hardware of an acceptable cost and acceptable power/energy requirements.

The present disclosure recognizes that acceptable performance that meets the rigorous demands of today's fuel systems can be achieved with a lesser hardware requirement associated with the driver circuit 33 utilizing the efficient control wave form of the present disclosure. The present disclosure teaches the use of a relatively brief but high boost voltage to initiate current in the solenoid coil and then drop to battery voltage and modulate to maintain a high current level in the solenoid during the so called pull-in duration. The high boost current value should speed up the force rise at the beginning of an event to overcome other forces, such as a spring pre-load. Quickly dropping to battery voltage may lead to a relatively slower start of motion for the armature, but the higher current level achieved with battery voltage can result in armature travel times comparable to prior art wave forms that rely upon boost voltage during the entire pull in duration. The present disclosure recognizes that a major cost and performance driver is the power/energy demands of the driver circuit 33 and its associated boost power source 34. Whereas the power/energy drawn directly from battery 50 during a majority of a solenoid actuation event is of little concern. The wave form of the present disclosure relies upon substantially less boost power/energy than that associated with the prior art, and also eliminates so called current chops to control current while the boost voltage is applied.

Figure 3:
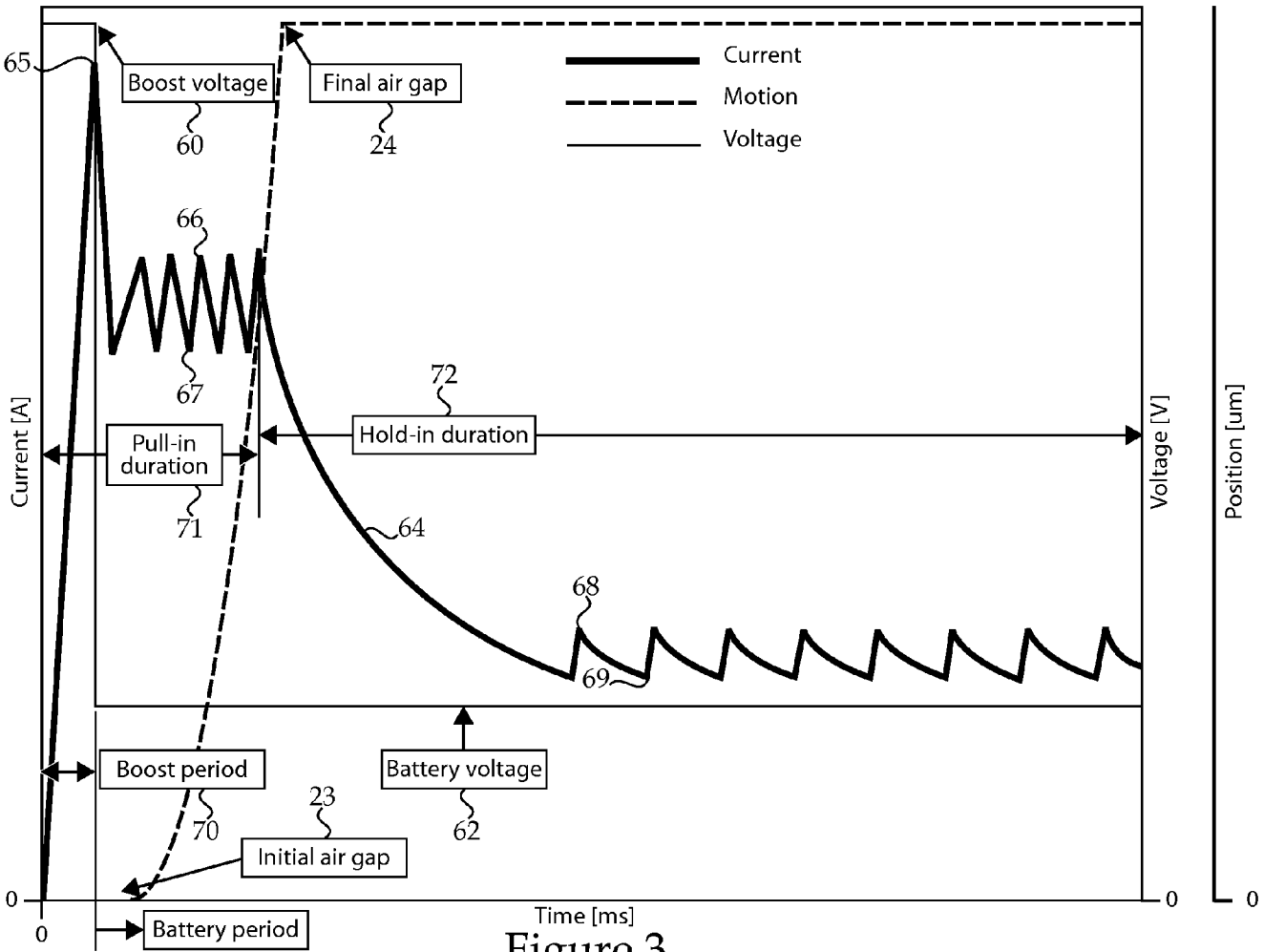
FIG. 3 is an overlay of voltage, solenoid coil current and armature position versus time utilizing a control wave form according to the present disclosure.

Referring now to FIGS. 2 and 3, an example solenoid actuation event is graphed in FIG. 3 as per the actuation algorithm 80 of FIG. 2. The process starts at Start 81 and leads to a query 82 as to whether it is time to initiate a start of injection or other solenoid actuation event (pumping event in the case of a pump). If not, the logic circles back to repeat the query at a subsequent clock time for processor 31. When it is time to start the injection event, electronic controller electrically connects a solenoid coil circuit 22 of one of the fuel injectors 15 to driver circuit 33 to apply a boost voltage 60 at the relevant solenoid coil port 38 as per box 84. Electronic controller 30 is configured to monitor the solenoid coil current allowing for the query 85. The monitored solenoid coil current is compared to a predetermined trigger current 65 at query 85. If the current level 64 has not yet reached trigger current 65, boost voltage is maintained for another time increment of processor 31. When the answer to query 85 is yes, the logic then advances to box 86 where the solenoid coil circuit 22 is disconnected from driver circuit 33. As expected, solenoid circuit current 64 will abruptly start decaying from the peak current associated with trigger current 65. Next, the electronic controller 30 connects the solenoid coil circuit 22 to battery voltage 62 to complete a change from boost voltage 60 to battery voltage 62. In the case of the wave form shown in FIG. 3, this connection occurs when the monitored solenoid coil current 64 reaches a minimum pull-in current 67. On the otherhand, if the average pull-in current is set higher than trigger current 65, the disconnection from driver circuit 33 and the subsequent connection to battery might be facilitated as quickly as possible to lessen the interference that might be caused by eddy currents in driving the current level in the solenoid circuit upward on battery voltage to a desired pull-in current level. It is important to note that at this point in the actuation event, the armature is still at its initial air gap position 23. After the solenoid coil circuit 22 is connected to battery voltage 62, the logic query 88 is whether the end of the pull-in duration 71 has been reached. If not, the logic advances to a subsequent query 89 to determine whether the monitored solenoid current 64 has reached the predetermined maximum pull-in current 66. If so, the solenoid coil circuit is disconnected from battery voltage at box 90. If not, the solenoid coil circuit remains connected to battery voltage at box 87. After the solenoid coil circuit 22 is disconnected from battery voltage at box 90, the logic advances to query 91 to determined whether the monitored solenoid coil current 64 has dropped down to the minimum pull-in current 67. If so, the electronic controller 30 reconnects the solenoid coil circuit 22 to battery voltage at box 87. This process continues during the pull-in duration 71 producing the recognized current chop profile in which the solenoid coil current 64 is mentioned to oscillate between a predetermined minimum pull-in current 67 and a maximum pull-in current 66, that together result in an average desired pull-in current. One feature that will always appear in an efficient wave form of the present disclosure is that the current chop during the pull-in period will occur on battery voltage and not during the boost period 70 at boost voltage 60 as in prior art control wave forms. It is likely that sometime during the pull-in duration 71 that the armature will begin moving from its initial air gap position 23 toward its final air gap position 24.

When query 88 determines that the end of the pull-in duration 71 has been achieved, the hold-in duration 72 is initiated by disconnecting solenoid coil circuit 22 from battery voltage at box 92. When this occurs, the solenoid coil current 64 predictably decays as shown in FIG. 3. At query 93, electronic controller 30 determines whether the end of the actuation event has been achieved. If not, the logic advances to query 94 where the monitored solenoid coil current is compared to a minimum hold-in current 69. When the solenoid coil current level 64 has decayed to the minimum hold-in current 69, the solenoid coil circuit 22 is reconnected to battery voltage 62 at box 95. Next, at query 96, the monitored solenoid coil current 64 is compared to the maximum hold-in current 68. When the maximum hold-in current is reached, the solenoid coil circuit 22 is again disconnected from battery voltage 62 at box 92. The hold-in duration 72 continues with the solenoid coil current 64 maintaining oscillation between the maximum hold-in current 68 and the minimum hold-in current 69 until the query 93 determines that the end of the solenoid actuation event has arrived. Thereafter, the solenoid is deenergized by opening the solenoid coil circuit 22 and disconnecting the same from battery voltage 52 to end the event at 97. When this occurs, a spring or some other bias will push the armature from its final air gap position 24 back to its initial air gap position 23 to prepare for a subsequent actuation event. Although the wave form of the present disclosure is illustrated as including only one hold-in current level tier, two or more lower hold-in current levels during the hold-in duration 72 would also fall within the scope of the present disclosure.

Figure 4:
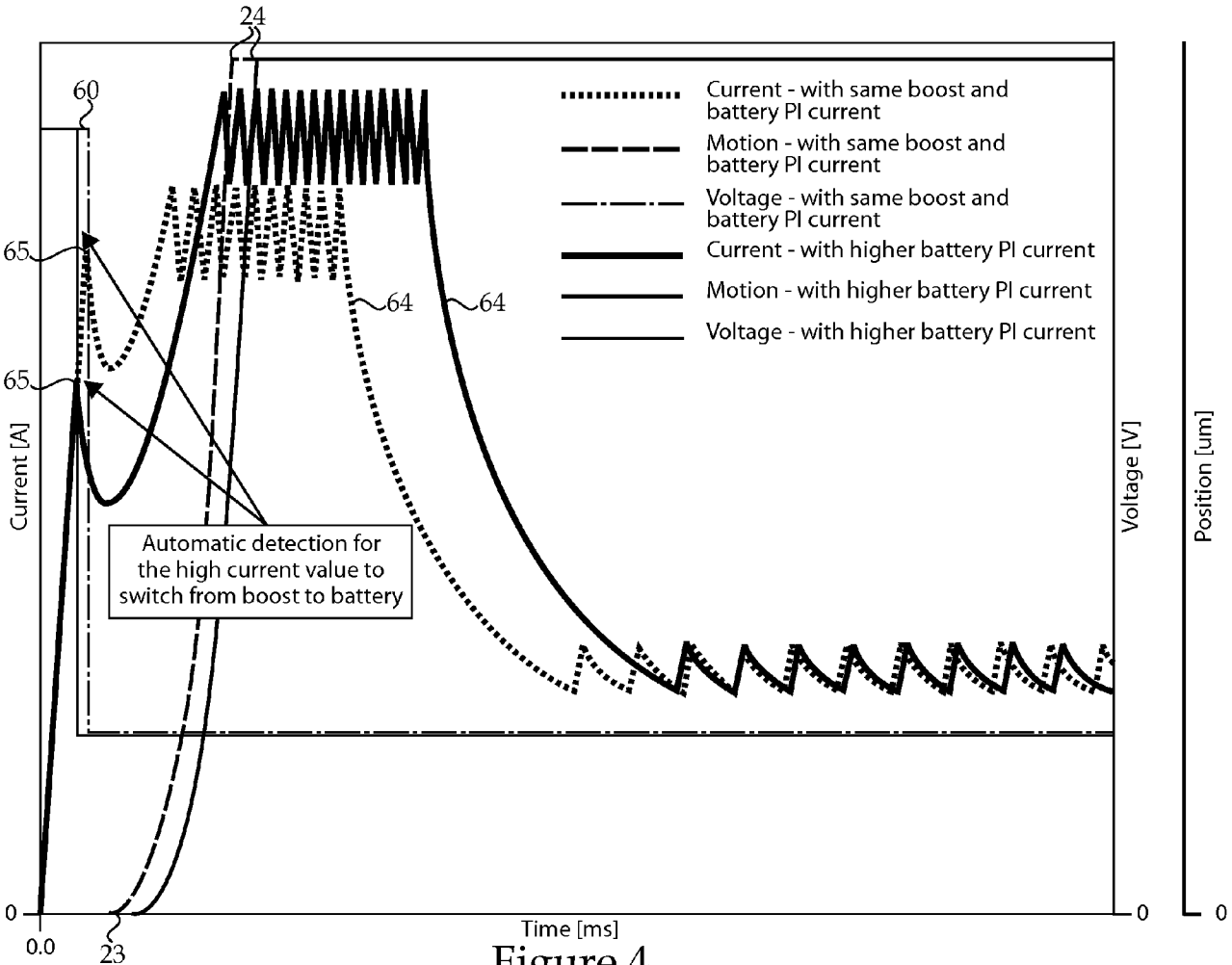
FIG. 4 is a graph similar to that of FIG. 3 except showing a comparison of two wave forms according to the present disclosure with different trigger currents and different pull-in current levels.

Referring now to FIG. 4, two more wave forms according to the present disclosure are compared with the solid line indicating a scenario when the trigger current 65 is set to be lower than the average solenoid coil current 64 during the pull-in duration, and the dotted line showing the scenario when the trigger current 65 is set equal to the average pull-in solenoid coil current 64. As expected, the duration of the boost voltage 60 is slightly longer with the higher trigger current 65. However, when one actually calculates the energy required from the boost power source 34 during the boost period 70, as much as one third less energy is required from the boost power source 34 when the pull-in solenoid current 64 on battery voltage is set higher than the trigger current 65 as per the solid line relative to that of the dotted line wave form. This substantial reduction in power/energy requirement is achieved with only a slight additional delay of when the armature starts moving from its initial air gap position 23 toward its final air gap position 24. Thus, depending upon the specific geometry of the application, the materials utilized, the number of turns in the solenoid coil, the battery voltage, etc., engineers might choose to set the average pull-in current solenoid current 64 on battery voltage to be higher than the trigger current 65 with only a small degradation in performance, but with a substantial savings in energy required and hence hardware required by the boost power source 34.

INDUSTRIAL APPLICABILITY

The efficient wave form for actuating solenoids according to the present disclosure finds general applicability in any high speed application that utilizes a solenoid. The present disclosure finds specific application in fuel systems generally, and especially to solenoids utilized to control fuel injection events in fuel injectors and possibly pumping events, such as in some high pressure pumps associated with common rail systems.

Although the disclosed strategy is taught as the electronic controller 30 monitoring a solenoid current level 64 in comparing the same to a trigger current 65, those skilled in the art will appreciate that the wave form of the present disclosure could be carried out by monitoring a duration of the boost voltage 60 only, with or without accompanying monitoring of the solenoid current level 64. In other words, lab experiments could correlate a boost period duration 70 with a trigger current level 65 so that duration could be monitored in place of current level and achieve similar results. However, in all cases of the present disclosure, their should be no current chop during the boost period 70 while operating on boost voltage 60 from the driver circuit 33. Instead, all of the current chop associated with the solenoid control wave form of the present disclosure occurs on battery voltage 60. The waveform of the present disclosure allows for comparable performance with regard to solenoid actuation, but achieves this comparable performance with a substantial lesser expenditure of power/energy during the boost period 70. As such, the wave form of the present disclosure relaxes demands upon the hardware associated with the boost power source 34 and the drive circuit 33 to potentially reduce costs while achieving performance levels comparable to the prior art wave forms.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A method of operating a fuel system for an engine, the method comprising the steps of:

energizing a solenoid of the fuel system;

de-energizing the solenoid;

the energizing step includes:

applying a boost voltage from an electronic controller across a solenoid coil circuit; and changing from the boost voltage to a reduced voltage responsive to a current in the solenoid coil circuit reaching a trigger current.

2. The method of claim 1 wherein the reduced voltage is a battery voltage of a battery; and the changing step includes electrically disconnecting the solenoid coil circuit from a boost power source, and electrically connecting the solenoid coil circuit to the battery.

3. The method of claim 2 including a step of modulating from the trigger current to one of a maximum pull-in current and a minimum pull-in current after the solenoid coil circuit is electrically connected to the battery;

maintaining a solenoid coil current between the minimum pull-in current and the maximum pull-in current for a first duration;

reducing the solenoid coil current to a minimum hold-in current after the first duration;

maintaining the solenoid coil current between the minimum hold-in current and a maximum hold-in current for a second duration; and the de-energizing step includes opening the solenoid coil circuit at an end of the second duration.

4. The method of claim 3 including a step of moving a solenoid armature from an initial air gap position toward a final air gap position after the changing step but during the first duration.

5. The method of claim 3 wherein the minimum pull-in current is greater than the trigger current.

6. The method of claim 5 wherein the reduced voltage is a battery voltage of a battery; and the changing step includes electrically disconnecting the solenoid coil circuit from a boost power source, and electrically connecting the solenoid coil circuit to the battery.

7. The method of claim 6 including a step of moving a solenoid armature from an initial air gap position toward a final air gap position after the changing step but during the first duration.

8. The method of claim 1 wherein the solenoid is part of fuel injector, and the energizing step is performed to initiate a fuel injection event.

9. The method of claim 1 wherein the solenoid is part of a pump, and the energizing step is performed as part of a pumping event.

10. An electronic controller for a fuel system of an engine, comprising a processor;

a memory in communication with the processor;

a solenoid coil circuit port;

a battery port;

a driver circuit that includes a boost power source;

a solenoid actuation algorithm stored on the memory and executable by the processor, and configured to electrically connect the solenoid coil circuit port to the driver circuit to provide a boost voltage, then electrically disconnect the solenoid coil circuit port from the driver circuit responsive to a current through the solenoid coil circuit port reaching a trigger current, and then electrically connect the solenoid coil circuit port to the battery port.

11. The electronic controller of claim 10 wherein the solenoid actuation algorithm is configured to modulate from the trigger current to one of a maximum pull-in current and a minimum pull-in current after the solenoid coil circuit port is electrically connected to the battery port, and configured to maintain a solenoid coil current through the solenoid coil circuit port between the minimum pull-in current and the maximum pull-in current for a first duration, and then reduce the solenoid coil current to a minimum hold-in current after the first duration, and then maintain the solenoid coil current between the minimum hold-in current and a maximum hold-in current for a second duration.

12. The electronic controller of claim 11 wherein the minimum pull-in current is greater than the trigger current.

13. A method of operating a solenoid of a fuel injector for an engine, the method comprising the steps of:

applying a boost voltage from an electronic controller across a solenoid coil circuit;

comparing a solenoid coil current to a predetermined trigger current; and changing from the boost voltage to a reduced voltage responsive to a current in the solenoid coil circuit reaching the trigger current.

14. The method of claim 13 wherein the changing step is performed before an armature has moved from an initial air gap position toward a final air gap position.

15. The method of claim 14 wherein the reduced voltage is a battery voltage of a battery;

the changing step includes electrically disconnecting the solenoid coil circuit from a boost power source, and electrically connecting the solenoid coil circuit to the battery.

16. The method of claim 15 including a step of modulating from the trigger current to one of a maximum pull-in current and a minimum pull-in current after the solenoid coil circuit is electrically connected to the battery;

maintaining a solenoid coil current between the minimum pull-in current and the maximum pull-in current for a first duration;

reducing the solenoid coil current to a minimum hold-in current after the first duration; and maintaining the solenoid coil current between the minimum hold-in current and a maximum hold-in current for a second duration.

17. The method of claim 16 wherein the minimum pull-in current is greater than the trigger current.

18. The method of claim 16 wherein the pull-in current maintaining step includes comparing a solenoid coil current to the maximum pull-in current;

electrically disconnecting the solenoid coil circuit from the battery when the solenoid coil current reaches the maximum pull-in current;

comparing the solenoid coil current to a minimum pull-in current; and reconnecting the solenoid coil circuit to the battery when the solenoid coil current reaches the minimum pull-in current.

19. The method of claim 18 wherein the hold-in current maintaining step includes comparing a solenoid coil current to the minimum hold-in current;

electrically connecting the solenoid coil circuit to the battery when the solenoid coil current reaches the minimum hold-in current;

comparing the solenoid coil current to a maximum hold-in current; and disconnecting the solenoid coil circuit from the battery when the solenoid coil current reaches the maximum hold-in current.

20. The method of claim 16 wherein the maximum pull-in current is less than the trigger current.

* * * * *